US009081361B2

(12) United States Patent
Yokoi

(10) Patent No.: US 9,081,361 B2
(45) Date of Patent: Jul. 14, 2015

(54) IMAGE FORMING APPARATUS HAVING CONTROLLER CONFIGURED TO JUDGE DEW CONDENSATION

(71) Applicant: Junichi Yokoi, Nagoya (JP)

(72) Inventor: Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/165,675

(22) Filed: Jan. 28, 2014

(65) Prior Publication Data

US 2014/0210928 A1 Jul. 31, 2014

(30) Foreign Application Priority Data

Jan. 28, 2013 (JP) ..... 2013-012783

(51) Int. Cl.
*B41J 2/45* (2006.01)
*G03G 21/20* (2006.01)
*G03G 15/04* (2006.01)

(52) U.S. Cl.
CPC ..... *G03G 21/203* (2013.01); *G03G 15/04054* (2013.01)

(58) Field of Classification Search
USPC ..... 347/14, 118, 238
See application file for complete search history.

(56) References Cited

U.S. PATENT DOCUMENTS

| | | | | |
|---|---|---|---|---|
| 6,266,074 | B1 * | 7/2001 | Koumura et al. | 347/133 |
| 2006/0222385 | A1 * | 10/2006 | Serita | 399/44 |
| 2010/0054813 | A1 | 3/2010 | Tamaru et al. | |
| 2012/0162343 | A1 * | 6/2012 | Fujishiro | 347/225 |

FOREIGN PATENT DOCUMENTS

JP 2010-052154 A 3/2010

* cited by examiner

*Primary Examiner* — Hai C Pham
(74) *Attorney, Agent, or Firm* — Banner & Witcoff, Ltd.

(57) ABSTRACT

There is provided an image forming apparatus including: an image forming section including a photosensitive body, and an LED array configured to expose the photosensitive body; and a controller configured to: make a judgment of a dew-condensation state of the LED array, and change a power supply state of the LED array based on the dew-condensation state.

20 Claims, 8 Drawing Sheets

Fig. 4

| MODE | TRANSPORT-ING | FAN | FIXING | TEMPERATURE CORRECTION (° C) | | FIRST-TIME PERIOD D (SECONDS) | |
|---|---|---|---|---|---|---|---|
| | | | | COMPONENT A | COMPONENT B | COMPONENT A | COMPONENT B |
| DURING PRINTING | YES | ON | ON | 3 | 2 | 3 | 2 |
| READY | NO | ON | ON | 2 | 1 | 2 | 1 |
| SLEEP | NO | ON | OFF | 3 | 1 | 2 | 1 |
| UPPER COVER OPEN | NO | ON | OFF | 4 | 1 | 4 | 1 |

Fig. 6

| TIMER (SECONDS) | EXTERNAL TEMPERATURE | EXTERNAL HUMIDITY | DEW-POINT TEMPERATURE | CORRECTED DEW-POINT TEMPERATURE | INTERNAL TEMPERATURE | RESULT OF JUDGMENT OF DEW-CONDENSATION |
|---|---|---|---|---|---|---|
| 0 | 32 | 82 | 28.43 | 31.43 | 33.3 | 1 |
| 30 | 32 | 82 | 28.43 | 31.43 | 33.3 | 1 |
| 60 | 33 | 88 | 30.59 | 33.59 | 33.3 | 1 |
| 90 | 32 | 88 | 29.60 | 32.60 | 33.3 | 1 |
| 120 | 32 | 85 | 29.01 | 32.01 | 33.7 | 1 |
| 150 | 33 | 88 | 30.59 | 33.59 | 33.7 | 1 |
| 180 | 33 | 88 | 30.59 | 33.59 | 33.7 | 0 |
| 210 | 32 | 88 | 29.60 | 32.60 | 33.7 | 1 |
| 240 | 33 | 88 | 30.59 | 33.59 | 33.7 | 1 |
| 270 | 33 | 90 | 30.98 | 33.98 | 34 | 0 |
| 300 | 33 | 90 | 30.98 | 33.98 | 34 | 0 |
| 330 | 33 | 90 | 30.98 | 33.98 | 34.3 | 0 |
| 360 | 33 | 90 | 30.98 | 33.98 | 34.3 | 0 |
| 390 | 33 | 90 | 30.98 | 33.98 | 34.3 | 0 |
| 420 | 33 | 88 | 30.59 | 33.59 | 34.7 | 0 |
| 450 | 33 | 90 | 30.98 | 33.98 | 34.7 | 0 |
| 480 | 33 | 90 | 30.98 | 33.98 | 34.7 | 0 |
| 510 | 33 | 90 | 30.98 | 33.98 | 35 | 0 |
| 540 | 33 | 90 | 30.98 | 33.98 | 35.5 | 0 |
| 570 | 33 | 90 | 30.98 | 33.98 | 35.5 | 0 |
| 600 | 33 | 88 | 30.59 | 33.59 | 35.5 | 0 |
| 630 | 33 | 85 | 30.00 | 33.00 | 36 | 0 |
| 660 | 34 | 82 | 30.39 | 33.39 | 36 | 0 |
| 690 | 34 | 82 | 30.39 | 33.39 | 36 | 0 |
| 720 | 33 | 81 | 29.21 | 32.21 | 36.3 | 0 |
| 750 | 33 | 81 | 29.21 | 32.21 | 36.3 | 0 |
| 780 | 34 | 81 | 30.19 | 33.19 | 36.7 | 0 |
| 810 | 34 | 79 | 29.79 | 32.79 | 36.7 | 0 |
| 840 | 33 | 75 | 28.00 | 31.00 | 36.7 | 0 |
| 870 | 33 | 75 | 28.00 | 31.00 | 36.7 | 0 |
| 900 | 34 | 75 | 28.97 | 31.97 | 37 | 0 |

IMAGE FORMING APPARATUS HAVING CONTROLLER CONFIGURED TO JUDGE DEW CONDENSATION

CROSS REFERENCE TO RELATED APPLICATION

The present application claims priority from Japanese Patent Application No. 2013-012783 filed on Jan. 28, 2013, the disclosure of which is incorporated herein by reference in its entirety.

BACKGROUND OF THE INVENTION

1. Field of the Invention

The present invention relates to an image forming apparatus in which it is possible to make a judgment of a dew-condensation inside a main body of an apparatus (hereinafter, referred to as "a dew-condensation state"), and to carry out an appropriate operation according to the dew-condensation state.

2. Description of the Related Art

An image forming apparatus of an electrophotographic type, which includes an exposing unit having an LED array in which LEDs are arranged in a row in a direction of width of paper, has hitherto been known.

SUMMARY OF THE INVENTION

However, when the image forming apparatus is moved all of a sudden from a cold room to a warm room, sometimes there is a dew condensation inside the main body. When the apparatus is operated in a state of dew formed, there is a possibility of malfunction due to corrosion of a circuit in a semiconductor chip which forms the LED array. Moreover, there is a possibility of various malfunctions occurring due to the dew condensation even in components other than the LED array.

Therefore, an object of the present invention is to provide an image forming apparatus which is capable of making a judgment of the dew-condensation state inside the main body, and carrying out an appropriate operation according to the dew-condensation state.

According to an aspect of the present teaching, there is provided an image forming apparatus configured to form an image on a recording sheet, including:

an image forming section including a photosensitive body, and an LED array configured to expose the photosensitive body; and a controller configured to:

make a judgment of a dew-condensation state of the LED array, and change a power supply state of the LED array based on the dew-condensation state.

According to such an arrangement, the power supply state of the LED array is changed according to the dew-condensation state of which the controller has made a judgment such as, there is no dew condensation, there is little dew condensation, and there is a dew condensation. Therefore, it is possible to operate the LED array appropriately in accordance with the dew-condensation state.

BRIEF DESCRIPTION OF THE DRAWINGS

FIG. 4 is a diagram showing an example of settings of a correction temperature and a first time;

FIG. 6 is a table showing a change in temperature and a table showing a judgment result of dew condensation after the power supply is put ON; and FIG. 7 is a graph showing a change in a corrected dew point temperature and an internal temperature after the power supply is put ON.

DETAILED DESCRIPTION OF THE PREFERRED EMBODIMENTS

Next, an embodiment of the present teaching will be described below in detail while referring to the accompanying diagrams. In the following description, directions will be defined based on a viewpoint of a user using a color printer 1. In other words, a left side, a right side, a front side, and a rear side with respect to a paper surface of FIG. 1 will be defined as 'front', 'rear', 'right', and 'left' respectively. Moreover, an upper side and a lower side in FIG. 1 will be defined as 'up' and 'down', respectively.

<Schematic Structure of Color Printer>

Figure 1:
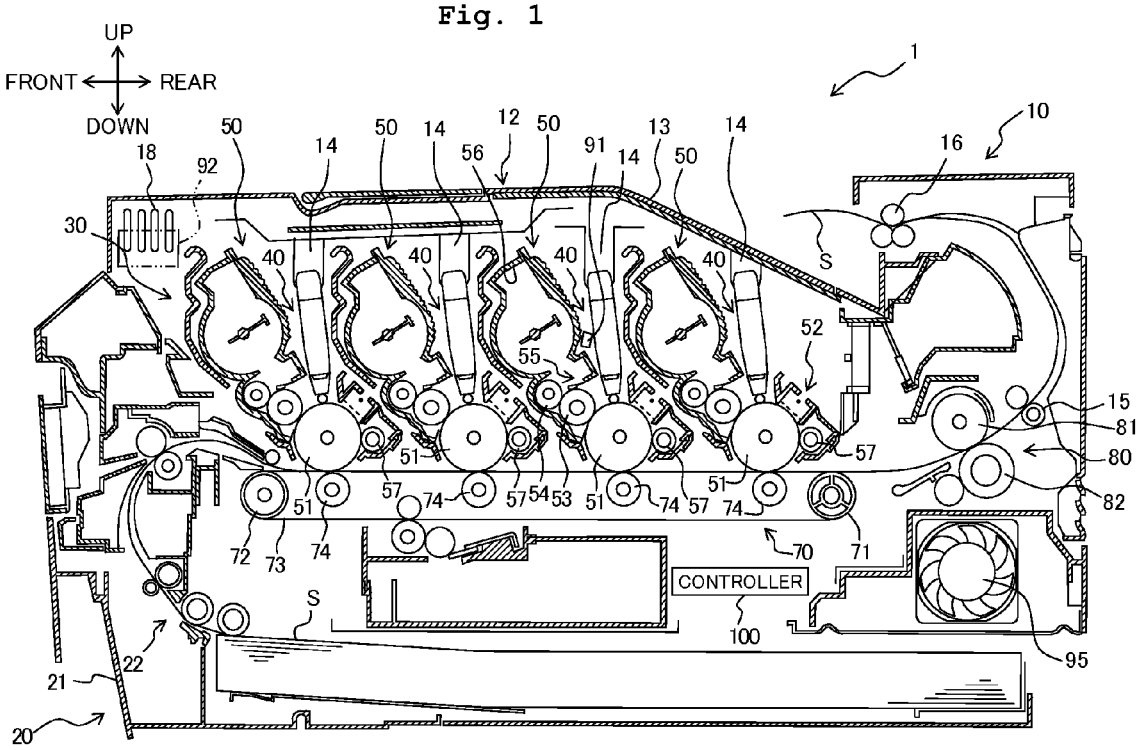
FIG. 1 is a diagram showing a schematic structure of a color printer as an example of an image forming apparatus according to an embodiment of the present invention.

As shown in FIG. 1, the color printer 1 includes a paper feeding section 20 and an image forming section 30 inside a casing 10. An upper cover 12 is provided at an upper side of the casing 10. The upper cover 12 is configured to rotate around a supporting point at a rear side thereof, to open and close the casing 10.

The paper feeding section 20 mainly includes a paper feeding tray 21 which accommodates papers S, and a feeding mechanism 22 which feeds the paper S from the paper feeding tray 21 to the image forming section 30, provided at a lower portion inside the casing 10. The papers S in the paper feeding tray 21 are separated and fed one-by-one to the image forming section 30 by the feeding mechanism 22.

The image forming section 30 mainly includes four LED units 40, four process cartridges 50, a transferring unit 70, and a fixing unit 80 as an example of a fixing device.

The LED unit 40 includes a plurality of LEDs, or in other words, an LED array, which is not shown in the diagram but is arranged to face the photosensitive drum 51 at an upper side of a photosensitive drum 51 as an example of a photosensitive body. The LED unit 40 exposes a surface of the photosensitive drum 51 by blinking of the LEDs based on image data. Moreover, the LED unit 40 is held by the upper cover 12 via a holding portion 14, and is configured to separate apart from the photosensitive drum 51 by opening the upper cover 12.

The process units 50 are arranged in a row in a front-rear direction between the upper cover 12 and the paper feeding tray 21, and is detachably installed in the casing 10 in a case that the upper cover 12 is opened. Each process unit 50 mainly includes the photosensitive drum 51, a charger 52, a developing roller 53, a feeding roller 54, a layer-thickness regulating blade 55, a toner accommodating section 56 which contains a positively charged toner or developer, and a cleaning roller 57.

The transferring unit 70 is provided between the paper feeding section 20 and the process unit 50, and mainly includes a drive roller 71, a driven roller 72, a transporting belt 73, and four transfer rollers 74. The transporting belt 73 is put around the drive roller 71 and the driven roller 72. A surface on an outer side of the transporting belt 73 faces the photosensitive drum 51, and each transfer roller 74 is arranged at an inner side of the transporting belt 73. The transporting belt 73 is pinched between each transfer roller 74 and the respective photosensitive drum 51.

The fixing unit 80 is provided at a rear side of the process unit 50 and the transferring unit 70, and mainly includes a heating roller 81 and a pressurizing roller 82. The pressurizing roller 82 is arranged to face the heating roller 81, and is configured to be pressed against the heating roller 81.

In the image forming section 30, firstly, the surface of each photosensitive drum 51 is charged uniformly by the charger 52, then the surface of the photosensitive drum 51 is exposed by LED light irradiated from each LED unit 40. Accordingly, an electric potential of a portion which is charged is lowered, and an electrostatic latent image based on image data is formed on each photosensitive drum 51.

Moreover, a toner in the toner accommodating section 56 is supplied to the developing roller 53 by the rotation of the feeding roller 54, and the toner enters between the developing roller 53 and the layer-thickness regulating blade 55 due to the rotation of the developing roller 53, and is carried on to the developing roller 53 as a thin film having a uniform thickness.

When the developing roller 53 makes a contact with the photosensitive drum 51, the toner that has been carried on to the developing roller 53 is supplied to the electrostatic latent image formed on the photosensitive drum 51. Accordingly, the toner is carried selectively on to the photosensitive drum 51. Accordingly, the electrostatic latent image becomes a visible image, and a toner image is formed by an inverse developing.

Next, when the paper S that has been fed on the transporting belt 73 passes between each photosensitive drum 51 and each transfer roller 74, the toner image formed on each photosensitive drum 51 is transferred onto the paper S. Moreover, when the paper S passes between the heating roller 81 and the pressurizing roller 82, the toner image transferred on to the paper S is subjected to thermal fixing.

A transporting roller 15 is provided at a rear side of the fixing unit 80, and a discharge roller 16 is provided at an upper side of the fixing unit 80. The paper S that has been discharged from the fixing unit 80 is discharged outside of the casing by the transporting roller 15 and the discharge roller 16, and is stacked on a paper discharge tray 13.

Figure 2:
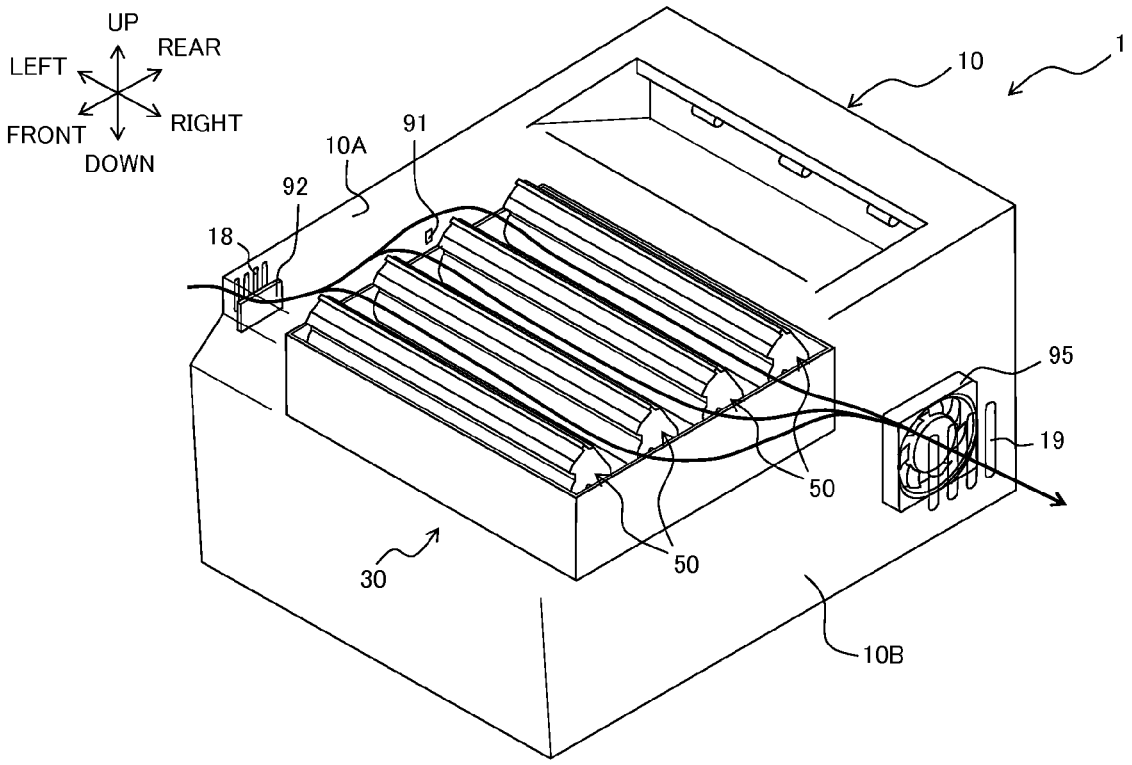
FIG. 2 is a diagram describing a flow of air in the color printer.

As shown in FIGS. 1 and 2, an internal temperature sensor 91 for detecting an internal temperature $T_{in}$ which is a temperature inside the casing 10 is provided to a left side wall 10A of the casing 10. The internal temperature sensor 91, for detecting indirectly the temperature of the LED unit 40, is arranged at a position corresponding to the third process unit 50 and the third LED unit 40 from front. In other words, the internal temperature sensor 91 is provided near one LED unit 40. Moreover, an air-inlet 18 is provided to a front-end portion of an upper portion of the left side wall 10A. A temperature and humidity sensor 92 for detecting an external temperature $T_{out}$ which is a temperature outside the casing 10, and an external humidity H which is humidity outside the main body is provided to face the air-inlet 18. An exhaust port 19 is provided in a right side wall 10B of the casing 10, at a rear-end portion of a lower side. An exhaust fan 95 as an example of a fan is provided to face the exhaust port 19.

In this case, as the exhaust fan 95 is driven, air outside the casing 10 is sucked in through the air-inlet 18, and after coming in contact with the temperature and humidity sensor 92, the air flows from a front to a rear inside the casing 10 along the left side wall 10A as shown in FIG. 2. Moreover, the air passes through each process unit 50 and flows from the left side wall 10A toward the right side wall 10B, and further from the front to the rear inside the casing 10 along the right side wall 10B, and is discharged to outside of the casing 10 through the exhaust fan 95 and the exhaust opening 19.

<Arrangement for Judgment of Dew-Condensation State>

As shown in FIG. 1, the color printer 1 includes a controller 100 arranged at an appropriate location in the casing 10. The controller 100 carries out a control of printing by the image forming section 30 and a control of transporting of the paper S, and also makes a judgment of a dew-condensation state inside the casing 10. The controller 100 is not necessarily required to be arranged at the interior of the casing 10, and may be arranged outside of the casing 10.

Figure 3:
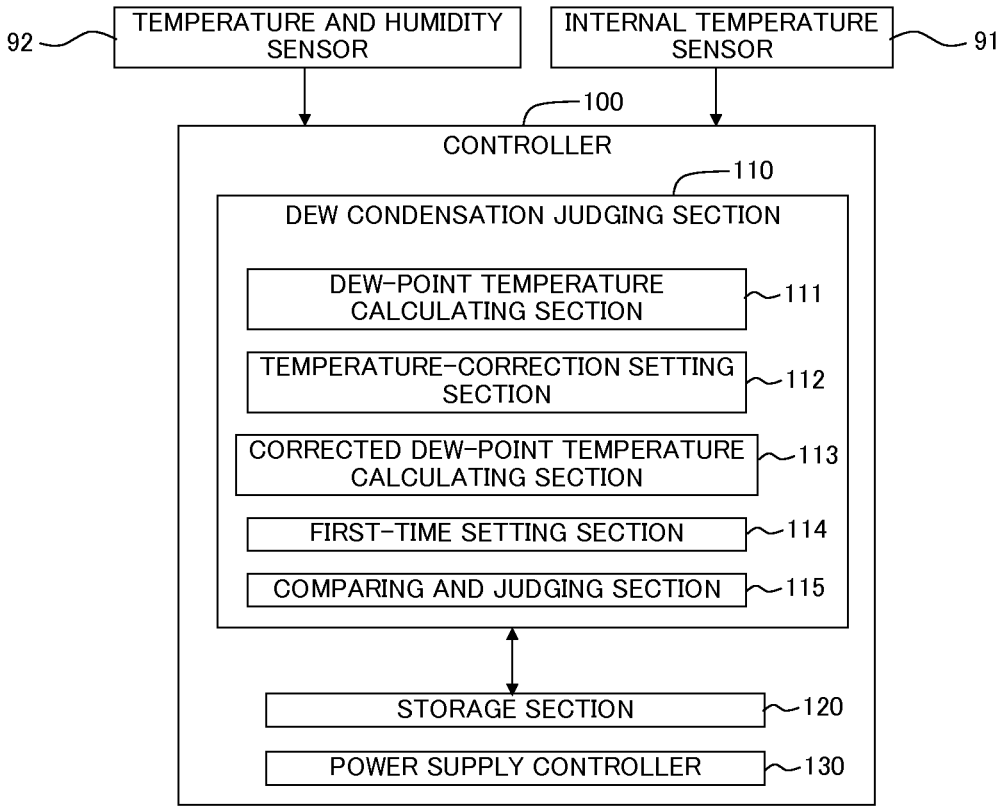
FIG. 3 is a block diagram showing a configuration of a controller.

As shown in FIG. 3, the controller 100 includes a dew-condensation state judging section 110, a storage section 120, and a power supply control section 130 as an arrangement related to making a judgment of a dew-condensation state, and recording.

The dew-condensation state judging section 110 makes a judgment of a dew-condensation state inside the casing 10 based on the external humidity H and the external temperature $T_{out}$ detected by the temperature and humidity sensor 92. For this, the dew-condensation state judging section 110 includes a correction-temperature setting section 112, a corrected dew point temperature calculating section 113, a first-time setting section 114, and a comparing and judging section 115.

The dew point temperature calculating section 111 calculates a dew point temperature $T_d$ by a known calculating formula, based on the external temperature $T_{out}$ and the external humidity H. Concretely, the dew point temperature calculating section 111 calculates a saturated water vapor pressure from a Sonntag formula, and calculates a water vapor pressure e at the external temperature $T_{out}$ from $e=H/100\times ew$. Moreover, in a case of $y\geq 0$, the dew point temperature calculating section 111 calculates the dew point temperature $T_d$ from $T_d=13.715y+8.4262\times10^{-1}y^2+1.9048\times10^{-2}y^3+7.8158\times10^{-3}y^4$, wherein y is defined as: $y=\ln(e/611.213)$. Further, in a case of $y<0$, the dew point temperature calculating section 111 calculates $T_d$ by $T_d=13.7204y+7.36631\times10^{-1}y^2+3.32136\times10^{-2}y^3+7.78591\times10^{-4}y^4$.

The correction temperature setting section 112 determines a correction temperature M that is to be added to the dew point temperature Td according to an operating state of the apparatus.

The corrected dew point temperature calculating section 113 calculates a corrected dew point temperature $Td_M$ by adding the correction temperature M to the dew point temperature $T_d$.

The first-time setting section 114 sets a difference between a first-time which is a time at which the corrected dew point temperature $Td_M$ which becomes a judgment criterion for dew condensation has been calculated, and a second-time which is a time of the internal temperature $T_{in}$ for comparing with the corrected dew point temperature $Td_M$. In other words, even when the air flows into the casing 10 from the outside, the units inside the casing are not heated up immediately, and since there is a slight delay in rising of temperature as compared to the internal temperature sensor 91, a first time period D is to be set according to the operating state of the apparatus, as a time for correcting the delay.

Here, a method of setting the correction temperature M by the correction temperature setting section 112 and a method of setting the first time period D by the first-time setting section 114 will be described below.

It is possible to set the correction temperature M and the first time period D according to how close a component which has to make a judgment of a dew-condensation state is from the air-flow path inside the casing. In other words, it is possible to set the correction temperature M and the first time period D according to how much effect of the air flow is there on the components for which the judgment of dew condensation is to be made. Since the component close to the air-flow path is susceptible to be subjected to dew condensation, it is preferable to make the correction temperature M high and the first time period D long so that it is strongly prone to be judged as a dew-condensation state. Conversely, in a case of making an attempt to make a judgment of a dew-condensation state of the component far from the air-flow path, it is preferable make the correction temperature M low and the first time period D short.

Moreover, in a case of making an attempt to judge a dew-condensation state of a component near a cover such as the upper cover 12, since it is extremely susceptible to be subjected to dew condensation due to an effect of an outside air when the cover is opened, for the components which are near the cover, it is preferable to make the correction temperature M high and the first time period D long when the cover is open.

Furthermore, in a case of making an attempt to judge a dew-condensation state of a component near the fixing unit 80, since the component is not susceptible to be subjected to dew condensation by being heated up by the fixing unit 80, it is preferable to make the correction temperature M low and the first time period D short. In a case of making an attempt to judge a dew-condensation state of a component far away from the fixing unit 80, it is preferable to make the correction temperature M high and the first time period D long. Moreover, for setting in more detail, it is preferable to make the correction temperature M low and the first time period D short only when the fixing unit 80 is ON.

Moreover, during transporting of the paper S, or in other words, during printing, since the air flow becomes strong and it is susceptible to have an effect of the air flow, it is preferable to make the correction temperature M high and the first time period D long.

From the abovementioned points, regarding an example of setting the correction temperature M and the first time period D for a component A which is near the air flow path, the fixing unit 80, and the upper cover 12, and a component B which is far from the air flow path, the fixing unit 80, and the upper cover 12 for instance, the description will be made by referring to FIG. 4.

The component A is located nearer from the air flow path, the fixing unit 80, and the upper cover 12 than the component B. Therefore, the correction temperature M is to be set to be higher than the correction temperature M for the component B, and the first time period D is to be set to be longer than the first time period D for the component B in any of the modes.

Moreover, during printing, since the effect of the air flow is greater as compared to the effect of the air flow in a ready state (print stand-by state with warming up of the fixing unit 80 already carried out), the correction temperature M is to be set higher and the first time period D is to be set longer for the component A than in the ready state. The ready state is a state in which the warming up of the fixing unit 80 is over, and it is in a stand-by state for printing.

Furthermore, in a sleep state (a state in which the fixing unit 80 is OFF), since there is no heating up of the component A due to the fixing unit 80, the correction temperature M is to be set higher for the component A than in the ready state. The sleep state is a state in which the fixing unit 80 is OFF.

Moreover, in the state of the upper cover 12 open, since the component A has a strong effect of outside air, the correction temperature M is to be set higher and the first time period D is to be set longer for the component A than in the sleep state.

The comparing and judging section 115 compares the corrected dew point temperature $Td_M$ at the first-time and the internal temperature $T_{in}$ at the time prior to the first-time by the first time period D only, and makes a judgment that it is a dew-condensation state when the internal temperature $T_{in}$ is lower. A fact that the judgment has been made that it is a dew-condensation state is recorded in the storage section 120. Moreover, the comparing and judging section 115 outputs a result of the dew condensation judgment to the power supply control section 130, and also outputs a difference $Td_M$–Tin between the corrected due-point temperature $Td_M$ and the internal temperature $T_{in}$ as information indicating a degree of the dew condensation.

The storage section 120 is an area in which the result of the judgment made by the dew-condensation state judging section 110 is to be recorded. Concretely, the time at which the dew-condensation state is assumed, the external temperature $T_{out}$, the external humidity H, and the internal temperature $T_{in}$ are written in the storage section 120. Moreover, the dew-condensation state judging section 110 counts up the number of times for which the dew-condensation state has been judged to be assumed, and writes the information in the storage section 120. Moreover, it is preferable to record not only the abovementioned information but also other information which may be considered to be useful for identifying the dew condensation and malfunction, such as information of the external temperature $T_{out}$, the external humidity H, the internal temperature $T_{in}$, an operation mode, and a transporting state of the paper S for a predetermined time till the dew-condensation state is assumed.

The controller 100 makes the judgment of a dew-condensation state according to the abovementioned arrangement at a predetermined time interval during a predetermined time period (hereinafter, also called as a second time) after the power supply to the color printer 1 is put ON. It is possible to carry out at an interval of thirty seconds for instance, as the predetermined time interval.

The power supply control section 130, in addition to exposing the photosensitive drum 51 for image formation, controls a power supply state of the LED unit 40 according to the dew-condensation state of which the dew-condensation state judging section 110 has made a judgment after the start-up of the color printer 1. Power supply states of the LED unit 40 according to the dew-condensation state include a first state, a second state and a third state. In the first state, the power is supplied to the LED unit 40 but the LED unit 40 is not let to emit light. In the second state, no power is supplied to the LED unit 40. In the third state, the power is supplied to the LED unit 40, and the LED unit 40 is made to emit light continuously. The first state is a stand-by state which enables the LEDs of the LED unit 40 to emit light in preparation for the start of image formation. The second state is a state which is to be assumed for suppressing corrosion of the LED unit 40. The third state is a state which is for making the LEDs emit light not for image formation, but for causing the temperature of the LED unit 40 to increase and drying rapidly the moisture that is formed as dew on the LED unit 40.

In a case that the power supply control section 130 has received a judgment result from the dew-condensation state judging section 110 that it is not a dew-condensation state, the power supply control section 130 controls the LED unit 40 to the first state. When the LED unit 40 is controlled to realize the second state or the third state due to the judgment that it has been the dew-condensation state before that, the power supply control section 130 also controls the LED unit 40 to the first state. In other words, not only in a case in which it is not a dew-condensation state at the time of start-up of the color printer 1, but also in a case in which the dew-condensation state has been eliminated, the power supply control section 130 controls the LED unit 40 to realize the first state for preparing for a state in which the printing is possible.

Moreover, in a case in which the power supply control section 130 has received a judgment result from the dew-condensation state judging section 110 that it is a dew-condensation state, the power supply control section 130 sets the LED unit 40 either to the second state or to the third state according to a differential value of the "$Td_M$–$T_{in}$" which indicates the dew-condensation state. Concretely, in a case in which "$Td_M$–$T_{in}$" is greater than a threshold value $\Delta T_{th}$ which is a predetermined reference value, or in other words, in a case in which the degree of dew condensation is particularly strong, the power supply control section 130 puts the power supply of the LED unit 40 OFF and puts the LED unit 40 in the second state. Whereas, in a case in which "$Td_M$–$T_{in}$" is not greater than the threshold value $\Delta T_{th}$, or in other words, in a case in which the degree of dew condensation is not particularly strong, the power supply control section 130 makes the LEDs of the LED unit 40 emit light continuously for a predetermined time period and puts the LED unit 40 in the third state. The predetermined time is set according to the dew-condensation state. In other words, the predetermined time period is set to be longer in a case in which the degree of dew condensation is stronger than in a case in which the degree of dew condensation is weaker. For instance, higher the value of "$Td_M$–$T_{in}$" which indicates the degree of dew condensation, longer is the predetermined time period to be set. After the light emission for the predetermined time period, if the dew-condensation state is eliminated, the power supply control section 130 changes the LED unit 40 from the third state to the first state.

In a case in which the dew-condensation state judging section 110 has made a judgment that it is a dew-condensation state, the controller 100 drives the fixing unit 80 and the exhaust fan 95 by a control section which is not shown in the diagram. The driving of the fixing unit 80 and the exhaust fan 95 may be carried out for a predetermined time period set in advance or may be carried out till the dew-condensation state is eliminated.

<Processing of Making Judgment of Dew-Condensation State and of Power Supply Control>

Figure 5A:
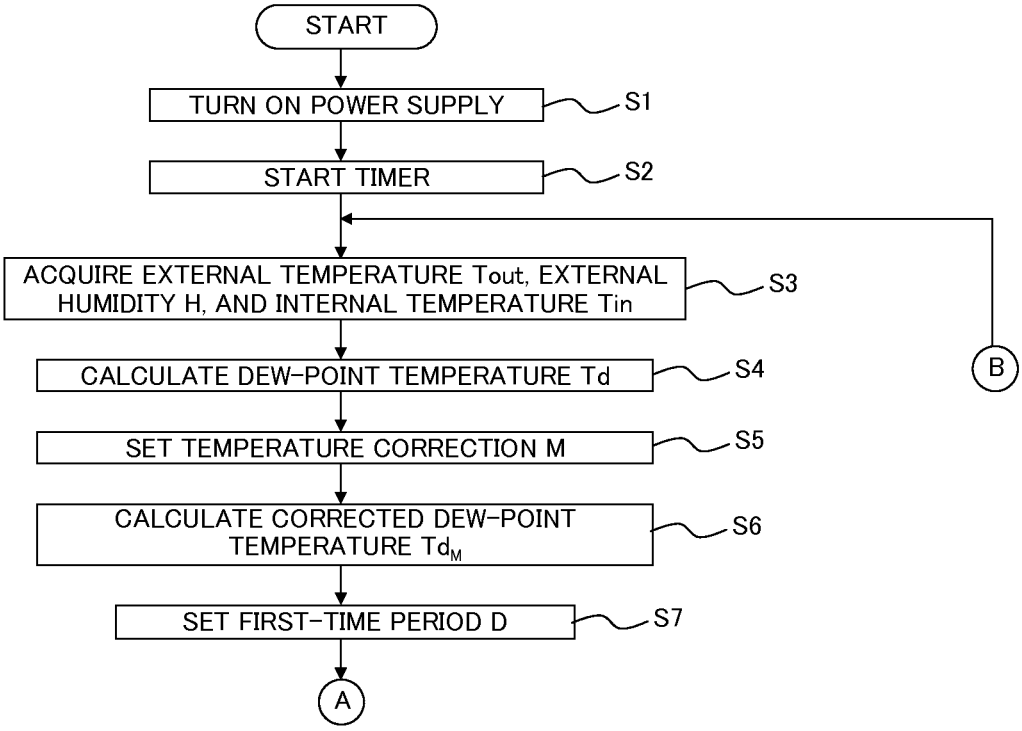
FIGS. 5A and 5B are flowcharts showing a processing of making a judgment of dew-condensation state and of a power supply control.
Figure 5B:
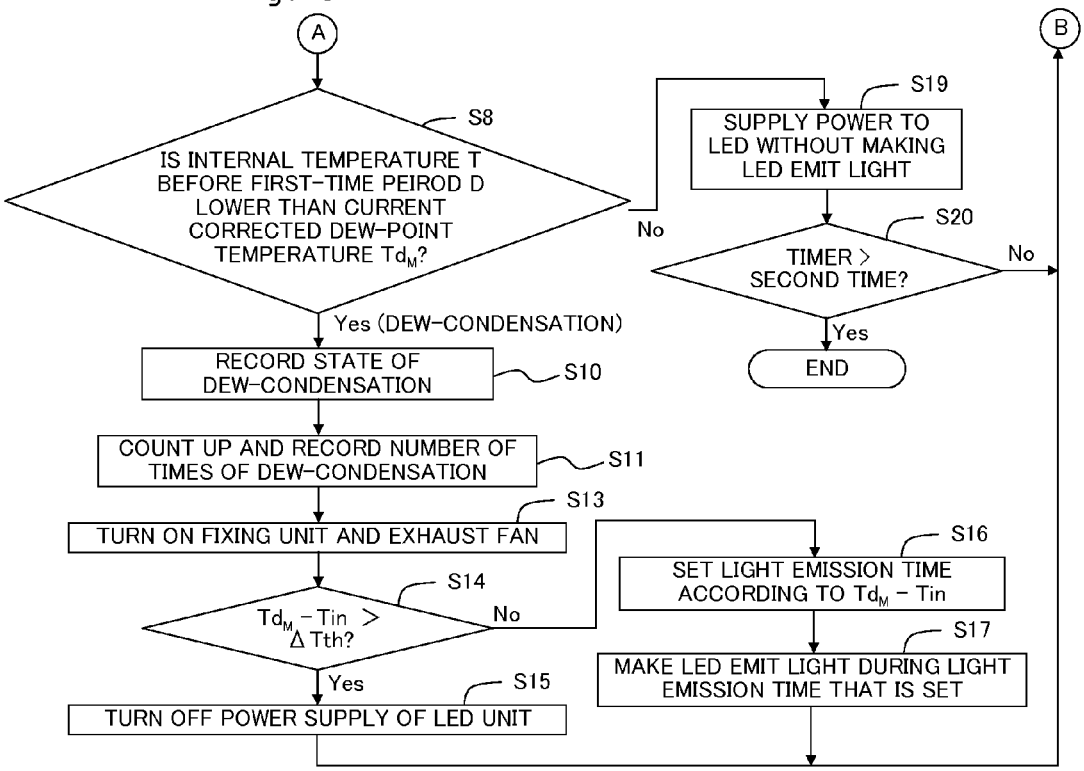

Next, an example of a processing for making a judgment of the dew-condensation state will be described below by referring to FIGS. 5A and 5B. In FIGS. 5A and 5B, only the processing for making a judgment of the dew-condensation state which is made after the power supply is put ON, and processing related to the supply of power to the LED unit 40 is indicated.

As the power supply to the color printer 1 is put ON (step S1, hereinafter, simply referred to as S1), the controller 100 starts a timer for measuring a time after the power supply is put ON (S2). Moreover, the controller 100 acquires the external temperature $T_{out}$ and the external humidity H from the temperature and humidity sensor 92, and also acquires the internal temperature $T_{in}$ from the internal temperature sensor 91 (S3).

Moreover, the dew point temperature calculating section 111 calculates the dew point temperature $T_d$ from the external temperature $T_{out}$ and the external humidity H (S4). Next, the correction-temperature setting section 112 sets the correction temperature M in accordance with the operating state of the color printer 1 (S5). Furthermore, the corrected dew point temperature calculating section 113 adds the correction temperature M to the dew point temperature $T_d$, and calculates the corrected dew point temperature $Td_M$ (S6). Moreover, the first-time setting section 114 sets the first time period D in accordance with the operating state of the color printer 1 (S7).

Next, the comparing and judging section 115 compares the internal temperature $T_{in}$ at a second time, which is a time prior to by the first time period D, and the corrected dew point temperature $Td_M$ at the first time, which is the current time. In a case in which the internal temperature $T_{in}$ is not lower than the corrected dew point temperature $Td_M$ (No at step S8), the comparing and judging section 115 makes a judgment that it is not a dew-condensation state. In a case in which it is not a dew-condensation state, the power supply control section 130 supplies power without making the LEDs of the LED unit 40 emit light (step S19, first state). Next, the controller 100 makes a judgment of whether or not the timer has elapsed the second time. In a case in which the second time has not elapsed (No at step S20), the process returns to step S3, and a judgment of the dew-condensation state is made repeatedly. In a case in which the second time has elapsed (Yes at step S20), the controller 100 terminates the processing of making a judgment of the dew-condensation state and the processing of supplying power to the LED unit 40.

On the other hand, in a case in which the internal temperature $T_{in}$ is lower than the corrected dew point temperature $Td_M$ (Yes at step S8), the comparing and judging section 115 makes a judgment that it is a dew-condensation state, and writes the judgment made in the storage section 120. Moreover, the dew-condensation state judging section 110 stores the dew-condensation state (time and temperature) etc. in the storage section 120 (S10), and counts up the number of times of dew condensation and writes in the storage section 120 (S11). The controller 100 drives the fixing unit 80 and the exhaust fan 95 (S13).

Next, the power supply control section 130 makes a judgment of whether or not the value of "$Td_M$–$T_{in}$" is greater than the threshold value $\Delta T_{th}$. In a case in which the value of "$Td_M$–$T_{in}$" is greater than the threshold value $\Delta T_{th}$ (Yes at step S14), the power supply control section 130 puts the power supply to the LED unit 40 OFF (step S5, second state), and the controller 100 returns the process to step S3 and repeats making a judgment of the dew-condensation state. On the other hand, when the value of "$Td_M$–$T_{in}$" is not greater than the threshold value $\Delta T_{th}$ (No at step S14), the power supply control section 130 sets the light emission time according to the value of "$Td_M$–$T_{in}$" (step S16), and makes the LEDs of the LED unit 40 emit light during the light-emission time (step S17, third state). Moreover, the controller 100 returns the process to step S3 and repeats making judging of the dew-condensation state. After the power supply control section 130 has brought the LED unit 40 to the second state or the third state, as the process returns to step S3 and making judgment of the dew-condensation state is repeated, the abovementioned processing is repeated till the dew-condensation state is eliminated, and the LED unit 40 is controlled to the first state (No at step S8).

Figure 7:
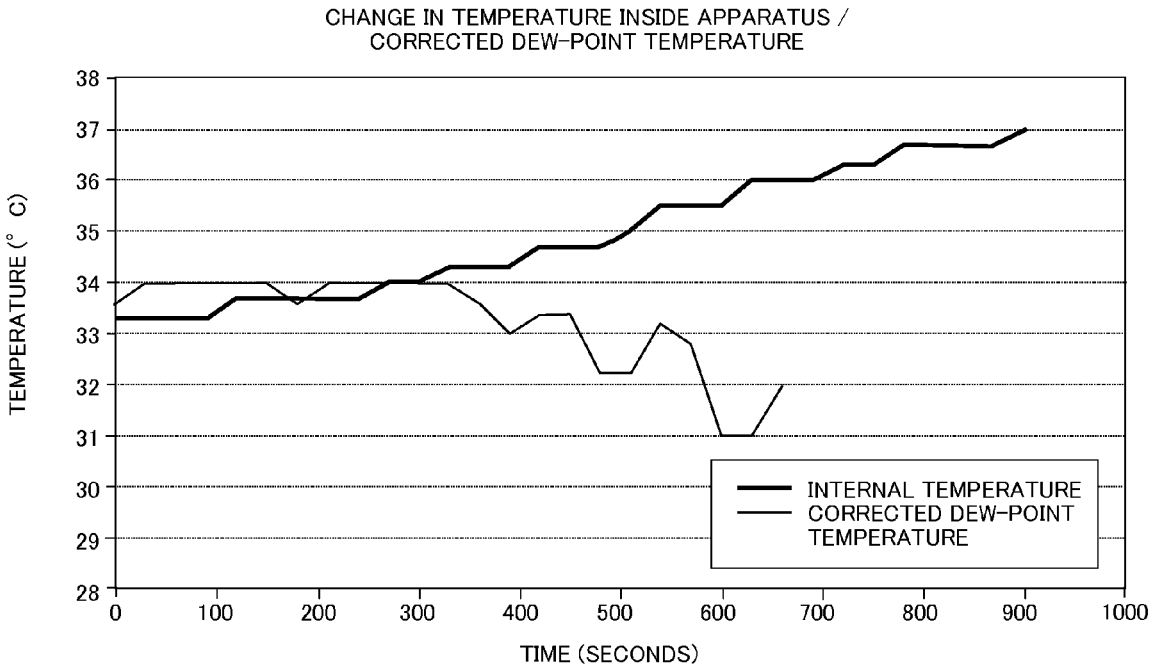

An example of a result after the judgment of the dew-condensation state has been made as mentioned above will be described below by referring to FIG. 6 and FIG. 7. In FIG. 6 and FIG. 7, the judgment of the dew-condensation state for 15 minutes after the power supply is put ON is shown, and the correction temperature M is let to be 3 degrees, and the first time period D is let to be four minutes.

As shown in FIG. 6, as the external temperature $T_{out}$ and the external humidity H is acquired at each time, the dew point temperature $T_d$ and the corrected dew point temperature $Td_M$ are calculated according to the external temperature $T_{out}$ and the external humidity H, and as indicated by an arrow mark, the corrected dew point temperature $Td_M$ and the internal temperature $T_{in}$ four minutes ago are compared. In a case in which the internal temperature $T_{in}$ is lower than the corrected dew point temperature $Td_M$ as a result of the comparison, and the judgment is made that it is a dew-condensation state, "1" is indicated as a judgment result of the dew-condensation state, and in a case in which the judgment is made that it is not a dew-condensation state, "0" is indicated as a judgment result of the dew-condensation state. As shown in FIG. 7, the internal temperature $T_{in}$ tends to rise gradually after the power supply is put ON, and as the internal temperature $T_{in}$ has rose sufficiently, there is no more possibility of dew condensation. In other words, as the internal temperature $T_{in}$ has rose to a temperature higher than the external temperature $T_{out}$ for instance, there is no more possibility of dew condensation. Therefore, by making the judgment of the dew-condensation state for a while after the power supply is put ON, it is possible to make a judgment of the dew-condensation state effectively.

In such manner, according to the color printer of the present embodiment, it is possible to make a judgment of the dew-condensation state of the LED unit 40. In this judgment, the corrected dew point temperature $Td_M$ which is a criterion for the judgment of the dew condensation is set to a temperature higher than the dew point temperature $T_d$ which is calculated from the external temperature $T_{out}$ and the external humidity H by an amount of the predetermined correction temperature M. Therefore, it is susceptible to make a judgment of the dew condensation due to the amount of the correction temperature M. Accordingly, in a case where there is a possibility of dew condensation, it is possible to make the judgment that it is a dew-condensation state assuredly.

Moreover, by comparing the corrected dew point temperature $Td_M$ at the first-time and the internal temperature $T_{in}$ at the time which is first time period D prior to the first-time, it is possible to make a judgment of the actual dew-condensation state correctly.

Furthermore, since the color printer 1, in accordance with the operating state of the apparatus, sets the appropriate correction temperature M and the first time period D, it is possible to make an accurate judgment of a dew-condensation state.

Moreover, since the dew-condensation state judging section 110 writes the result of judgment made in the storage section 120, and records in the storage section 120 the number of times for which the judgment that it is a dew-condensation state has been made, in a case in which there is a malfunction in the color printer 1, it is possible to carry out efficiently an analysis of the malfunction by referring to the record of the dew-condensation state.

Moreover, since the temperature and humidity sensor 92 is provided inside the casing 10, to face the air-intake opening 18, it is possible to detect the external temperature $T_{out}$ and the external humidity H correctly, and also to suppress the temperature and humidity sensor 92 from getting damaged by hitting an object at an exterior.

Furthermore, since the state of the power supply to the LED unit 40 is changed according to the dew-condensation state judged by the dew-condensation state judging section 110, it is possible to operate the LED array 40 appropriately according to the dew-condensation state. Note that the dew-condensation state includes the state in which there is no dew condensation, the state in which there is little dew condensation, and the state in which there is a dew condensation. In other words, in a case in which a judgment is made that there is a dew condensation on the LED unit 40, and the degree of dew condensation is particularly strong, the LED unit 40 is controlled to the second state in which no electric power is supplied. Therefore, it is possible to suppress the corrosion of the LED array of the LED unit 40.

Moreover, when the judgment is made that there is no dew condensation on the LED unit 40 while the LED unit 40 is being controlled to the second state, the LED unit 40 is controlled to the first state. Thereafter, the start-up of the LED unit 40 is enabled, and it is possible to shift to the image formation rapidly.

Furthermore, in a case in which a judgment is made that there is a dew condensation on the LED unit 40, and the dew-condensation state is not particularly strong, the LED unit 40 is controlled to the third state in which light is emitted from the LEDs. At this time, since the temperature of the LED unit 40 rises up, it is possible to eliminate rapidly the dew-condensation state of the LED unit 40.

For bringing the LED unit 40 to the third state, in the case in which the degree of dew condensation is stronger than the case in which the degree of dew condensation is weaker by making the predetermined time period for which the LED unit 40 is made to emit light longer, it is possible to eliminate the dew condensation assuredly.

Moreover, since the state of the power supply is changed to the first state after the dew-condensation state is eliminated by making the LED unit 40 emit light, the start-up of the LED unit 40 is enabled thereafter, and it is possible to shift to the image formation rapidly.

Furthermore, when the judgment has been made that there is a dew condensation on the LED unit 40, the fixing unit 80 is driven. Therefore, it is possible to eliminate the dew-condensation state rapidly by raising the temperature of surrounding of the LED unit 40 by the heat generated from the fixing unit 80.

Moreover, in a case in which the judgment has been made that there is a dew condensation on the LED unit 40, the exhaust fan 95 is driven. Therefore, it is possible to dry moisture that is formed as dew by circulating air outside the casing in the casing, while gradually heating up the inside of the apparatus by the flow of air circulated inside.

In the color printer 1, in a case in which the degree of dew condensation is weak, by raising the temperature of the LED unit 40 by making the LED unit 40 emit light, it is possible to eliminate the dew-condensation state rapidly. In a case in which the degree of dew condensation is strong, by not supplying the power to the LED unit 40, it is possible to suppress an occurrence of malfunction in the LED unit 40.

The embodiment of the present teaching has been described above. However, the present teaching is not restricted to the embodiment described above, and it is possible to make appropriate changes in a specific arrangement without departing from the scope of the teaching.

In the embodiment, the corrected dew point temperature $Td_M$ has been used as an example of the dew point temperature in the controller 100. However, instead of correcting the dew point temperature $T_d$, the degree of dew condensation may be judged from a value of difference "$T_d$–$T_{in}$" between the dew point temperature $T_d$ outside the casing 10 and the internal temperature $T_{in}$.

In the embodiment, the exhaust fan 95 has been exemplified as a fan. However, an air-intake fan can also be used as a fan.

In the embodiment, after letting the LED unit 40 to be in the third state at step S17 in FIG. 15, the process was returned to step S3 and the judgment of a dew-condensation state was made. However, after step S17, the process may be shifted to step S19, and the LED unit 40 may be changed into the first state.

In the embodiment, the detection of the external temperature outside the casing 10 and the detection of the external humidity outside the casing 10 were performed by an integrated temperature and humidity sensor. However, it is also possible to provide the external temperature sensor and the external humidity sensor separately.

In the embodiment, the correction temperature and the first-time period are changed according to the operating state of the apparatus. However, the correction temperature and the first-time may be fixed in constant values.

In the embodiment, the external temperature sensor and the external humidity sensor (the temperature and humidity sensor 92) have been provided inside the casing 10. However, the external temperature sensor and the external humidity sensor may be provided outside the apparatus main body. For instance, information of external temperature and external humidity may be acquired by receiving signals from a temperature sensor and a humidity sensor in the room by wireless communication.

In the embodiment, the color printer 1 which enables color print has been exemplified as an image forming apparatus. However, the present teaching is not restricted to a color printer, and the printer may be a printer, which enables only black-and-white print. Moreover, the image forming apparatus is not restricted to a printer, and it may be a copy machine or a multifunction device which includes a document reader such as a flatbed scanner.

What is claimed is:

1. An image forming apparatus configured to form an image on a recording sheet, comprising:

an image forming section including a photosensitive body, and an LED array configured to expose the photosensitive body; and a controller configured to:

make a judgment of a dew-condensation state of the LED array, and change a power supply state of the LED array based on the dew-condensation state, wherein the power supply state includes a first state in which electric power is supplied to the LED array, but the LED array is not made to emit light, and a second state in which no electric power is supplied to the LED array, and the controller is configured to let the power supply state be the second state in a case in which a judgment is made that there is dew condensation on the LED array.

2. The image forming apparatus according to claim 1, wherein the image forming section includes a fixing unit which is configured to heat the recording sheet to fix a developer thereon, and the controller is configured to drive the fixing unit in a case that a judgment is made that there is dew condensation on the LED array.

3. The image forming apparatus according to claim 1, further comprising:

a fan configured to discharge air inside the casing to outside of the casing, and the controller is configured to drive the fan in a case that a judgment is made that there is dew condensation on the LED array.

4. The image forming apparatus according to claim 1, wherein the controller is configured to let the power supply state be the first state in a case that a judgment is made that there is no dew condensation on the LED array while controlling such that the power supply state becomes the second state.

5. The image forming apparatus according to claim 1, wherein the power supply state includes a third state in which the electric power is supplied to the LED array to emit light, and the controller is configured to let the power supply state be the third state during a time period in a case that a judgment is made that there is dew condensation on the LED array.

6. The image forming apparatus according to claim 5, wherein the controller is configured to set the time period to be longer in a case in which a degree of dew condensation is strong than in a case in which a degree of dew condensation is weak.

7. The image forming apparatus according to claim 6, wherein the controller is configured to make a judgment of the degree of dew condensation based on a difference between a dew point temperature of air outside the casing and an internal temperature which is a temperature inside the casing.

8. The image forming apparatus according to claim 5, wherein the power supply state includes the first state in which the electric power is supplied to the LED array but the LED array is not made to emit light, and the controller is configured to change the power supply state from the third state to the first state after the time period has elapsed.

9. The image forming apparatus according to claim 5, wherein the image forming section includes a fixing unit configured to heat the recording sheet to fix a developer thereon, and the controller is configured to drive the fixing unit in a case in which a judgment is made that there is dew condensation on the LED array.

10. The image forming apparatus according to claim 5, further comprising:

a fan configured to discharge air inside the casing to outside of the casing, and the controller is configured to drive the fan in a case in which a judgment is made that there is dew condensation on the LED array.

11. The image forming apparatus according to claim 1, wherein the power supply state includes a third state in which the electric power is supplied to the LED array to emit light, and the controller is configured to let the power supply state be the second state in a case in which a degree of dew condensation of which the judgment is made, is stronger than a reference value, and to let the power supply state be the third state in a case in which the degree of dew condensation of which the judgment is made is weaker than the reference value, in a case that a judgment is made that there is dew condensation on the LED array.

12. The image forming apparatus according to claim 11, wherein the controller is arranged to make a judgment of a degree of dew condensation based on a difference between a dew point temperature of air outside the casing and an internal temperature which is a temperature inside the casing.

13. The image forming apparatus according to claim 1, further comprising:

an internal temperature sensor configured to detect the internal temperature which is a temperature inside the casing;

an external temperature sensor configured to detect an external temperature which is a temperature outside the casing; and an external humidity sensor configured to detect an external humidity which is a humidity outside the casing, wherein the controller is configured:

to compare the internal temperature and a corrected dew point temperature which is higher by a correction temperature than a dew point temperature that has been calculated from the external temperature and the external humidity, and to make a judgment that there is dew condensation in a case in which the internal temperature is lower than the corrected dew point temperature.

14. The image forming apparatus according to claim 13, wherein the controller is configured:

to compare a corrected dew point temperature which is higher by a predetermined correction temperature than a dew point temperature that has been calculated from the external temperature and the external humidity at a first-time, and an internal temperature at a second-time which is prior to the first-time by a first time period, and to make a judgment that there is dew condensation, in a case in which the internal temperature is lower than the corrected dew point temperature.

15. An image forming apparatus configured to form an image on a recording sheet, comprising:

an image forming section including a photosensitive body, and an LED array configured to expose the photosensitive body; and a controller configured to:

make a judgment of a dew-condensation state of the LED array, and change a power supply state of the LED array based on the dew-condensation state, wherein the power supply state includes a third state in which electric power is supplied to the LED array to emit light, and the controller is configured to let the power supply state be the third state during a time period in a case that a judgment is made that there is dew condensation on the LED array, and set the time period to be longer in a case in which a degree of dew condensation is strong than in a case in which a degree of dew condensation is weak.

16. The image forming apparatus according to claim 15, wherein the power supply state includes a first state in which the electric power is supplied to the LED array, but the LED array is not made to emit light, and a second state in which no electric power is supplied to the LED array, and the controller is configured to let the power supply state be the second state in a case in which a judgment is made that there is dew condensation on the LED array.

17. The image forming apparatus according to claim 16, wherein the controller is configured to let the power supply state be the first state in a case that a judgment is made that there is no dew condensation on the LED array while controlling such that the power supply state becomes the second state.

18. An image forming apparatus configured to form an image on a recording sheet, comprising:

an image forming section including a photosensitive body, and an LED array configured to expose the photosensitive body; and a controller configured to:

make a judgment of a dew-condensation state of the LED array, and change a power supply state of the LED array based on the dew-condensation state, wherein the power supply state includes a first state in which electric power is supplied to the LED array but the LED array is not made to emit light, and wherein the power supply state includes a second state in which electric power is supplied to the LED array to emit light, and the controller is configured to let the power supply state be the second state during a time period in a case that a judgment is made that there is dew condensation on the LED array, and change the power supply state from the second state to the first state after the time period has elapsed.

19. The image forming apparatus according to claim 18, wherein the power supply state includes a third state in which no electric power is supplied to the LED array, and the controller is configured to let the power supply state be the third state in a case in which a judgment is made that there is dew condensation on the LED array.

20. The image forming apparatus according to claim 19, wherein the controller is configured to let the power supply state be the first state in a case that a judgment is made that there is no dew condensation on the LED array while controlling such that the power supply state becomes the third state.

* * * * *